US009416568B2

(12) United States Patent
Promutico

(10) Patent No.: US 9,416,568 B2
(45) Date of Patent: Aug. 16, 2016

(54) DOOR LOCK DEVICE WITH AN OPENING BUTTON

(75) Inventor: Fabrizio Promutico, Turin (IT)

(73) Assignee: BITRON S.P.A., Turin (IT)

( * ) Notice: Subject to any disclaimer, the term of this patent is extended or adjusted under 35 U.S.C. 154(b) by 387 days.

(21) Appl. No.: 14/000,855

(22) PCT Filed: Mar. 14, 2012

(86) PCT No.: PCT/IT2012/000072

§ 371 (c)(1),
(2), (4) Date: Oct. 22, 2013

(87) PCT Pub. No.: WO2012/123980

PCT Pub. Date: Sep. 20, 2012

(65) Prior Publication Data

US 2014/0035294 A1 Feb. 6, 2014

(30) Foreign Application Priority Data

Mar. 15, 2011 (IT) ..... RM2011A0118

(51) Int. Cl.

| | |
|---|---|
| ***E05C 19/10*** | (2006.01) |
| ***E05C 3/16*** | (2006.01) |
| ***D06F 37/42*** | (2006.01) |
| *E05C 19/00* | (2006.01) |

(52) U.S. Cl.

CPC . *E05C 3/16* (2013.01); *D06F 37/42* (2013.01); *Y10S 292/37* (2013.01); *Y10S 292/69* (2013.01); *Y10T 292/0945* (2015.04); *Y10T 292/0947* (2015.04)

(58) Field of Classification Search

CPC ..... Y10S 292/37; Y10S 292/69
USPC ..... 292/98, 197, 219, 220, 224
See application file for complete search history.

(56) References Cited

U.S. PATENT DOCUMENTS

| | | | | | |
|---|---|---|---|---|---|
| 1,257,998 | A | * | 3/1918 | Gruber | E05C 1/14 292/170 |
| 2,468,644 | A | * | 4/1949 | Springer | E05B 85/24 292/207 |
| 2,546,703 | A | * | 3/1951 | Scanlan | E05C 1/14 292/153 |
| 3,617,957 | A | * | 11/1971 | Brighenti | D06F 37/42 200/61.64 |
| 3,892,933 | A | * | 7/1975 | Rocchitelli | B04B 7/06 200/61.64 |
| 5,484,178 | A | * | 1/1996 | Sandhu | E05B 83/30 292/169 |

(Continued)

FOREIGN PATENT DOCUMENTS

| | | |
|---|---|---|
| DE | 102007025295 | 12/2007 |
| EP | 2087829 | 8/2009 |

(Continued)

OTHER PUBLICATIONS

Written Opinion issued on Jun. 13, 2012 for International Application No. PCT/IT2010/000072 filed on Mar. 14, 2012 in the name of Bitron S.P.A.

(Continued)

*Primary Examiner* — Carlos Lugo
(74) *Attorney, Agent, or Firm* — Steinfl & Bruno, LLP

(57) ABSTRACT

A door lock device for a household appliance door provided with a prong is described. The device has a mechanical module for retaining the device in a closed position, or releasing the prong for opening the device. The device also has opening means with an unlock slider, returning means of the unlock slider, and an activation member.

9 Claims, 5 Drawing Sheets

(56) References Cited

U.S. PATENT DOCUMENTS 5,520,424 A * 5/1996 Hapke ..... D06F 37/42 292/198
5,626,374 A * 5/1997 Kim ..... E05C 1/145 292/137
5,857,720 A * 1/1999 Kim ..... E05B 5/00 292/98
6,145,898 A * 11/2000 Onderka ..... D06F 37/42 292/198
6,603,377 B2 * 8/2003 Cho ..... D06F 37/42 335/185
7,347,460 B2 * 3/2008 Ala ..... A47L 15/4259 292/216
7,393,024 B2 * 7/2008 Bella ..... E05B 83/30 292/170
7,441,813 B2 * 10/2008 Qin ..... H04B 1/3883 292/163
7,540,176 B2 * 6/2009 Arriola Arrizabalaga ..... E05B 1/0038 292/144
7,647,797 B1 * 1/2010 Viso Cabrera ..... E05B 47/0012 292/144
7,669,901 B2 * 3/2010 Paterson ..... E05C 3/30 292/102
7,775,566 B2 * 8/2010 Hanjono ..... B60R 7/06 292/202
8,789,858 B2 * 7/2014 Loret de Mola ..... E05B 5/00 292/164

FOREIGN PATENT DOCUMENTS

GB 1170158 11/1969
GB 1255845 12/1971

OTHER PUBLICATIONS

PCT International Search Report mailed on Jun. 13, 2012 for PCT Application PCT/IT2012/000072 filed on Mar. 14, 2012 in the name of Bitron S.P.A.

* cited by examiner

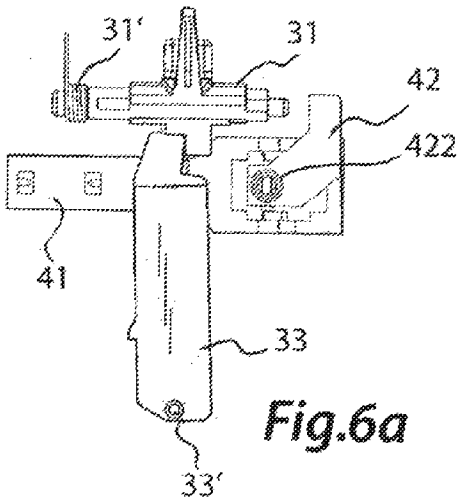
Fig.6a
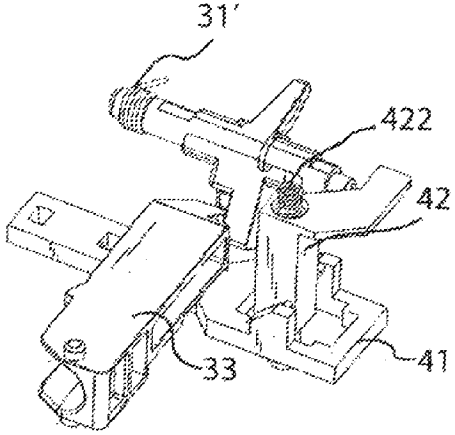
Fig.6b
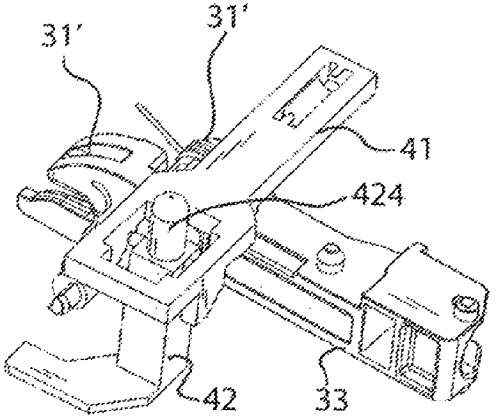
Fig.6c
Fig.7a
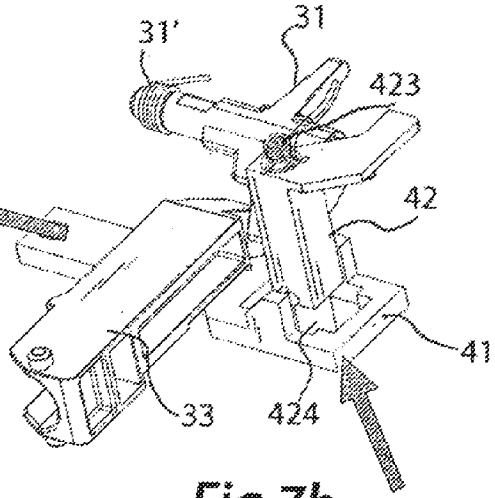
Fig.7b
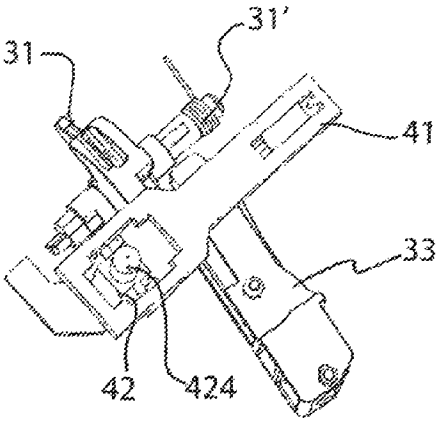
Fig.7c

DOOR LOCK DEVICE WITH AN OPENING BUTTON

CROSS REFERENCE TO RELATED APPLICATIONS

The present application is the US national stage of International Patent Application PCT/IT2012/000072 filed on Mar. 14, 2012 which, in turn, claims priority to Italian Patent Application RM2011A000118 filed on Mar. 15, 2011.

The present invention relates to a door lock device with a button opening.

More specifically, the invention concerns a door lock device for a household appliance, such as a washing machine or the like, studied and realized to allow opening of the door by pressing a button, eventually placed on the handle of the door itself.

In the following, the description will be directed to the application of the door lock device on the door of a washing machine, but it is clear that the same should not be considered limited to this specific use.

As it is well known, washing machines are currently provided with suitable safety systems, which prevent the opening of the door while the washing machine is activated and carries out a wash, and allow opening of said door only after an appropriate command to a door lock device.

Applicant has already filed the patent application no. RM2010A000498, which provides an unlocking member arranged on the door prong, capable of interacting, when activated, with the mechanical parts of the door to release the prong and to open said door. In particular, said unlocking member is slidingly coupled with said prong and provides an elongated portion having at the end an actuating member, such as a button or the like.

Compared to the mechanism described in the previous patent application, it is an object of the present invention to provide a door lock device which presents a simplified and without moving parts on the prong engagement mechanism, and which allows easy interfacing of the release mechanism with the other available moving members.

These and other results are obtained according to the invention with a door lock device provided with an opening mechanism activated by a button, which is integrated and, optionally, activated directly by the door handle.

It is therefore specific object of the present invention a door lock device for a household appliance door, said door being provided with a prong, said device comprising a mechanical module, for retaining in closed position, or releasing, for the opening, said prong, said device being characterized in that it further comprises opening means, comprising an unlock slider, movable between a first position and a second position, and capable to interact with said mechanical module, returning means of said unlock slider in said first position, and an activation member, having an activation element, like a button or the like, guiding means for the mutual movement being provided between said slider and said activation member, such that, when said prong is retained by mechanical module, pressing said activation element, said guiding means for the mutual movement between said unlock slider and said activation member cause the interaction of said unlock slider with said mechanical module, to release said prong, while when said prong is close to said mechanical module to be retained for closing the door, keeping pressed said activation element, said driving means of the mutual movement, between said unlock slider and said activation member, allow said mechanical module to retain said prong by the combined action of contrast means and said returning means of said unlock slider.

Always according to the invention, said guiding means of the mutual movement between said unlock slider, and said activation member could comprise one or more cams, each of which has an upper profile and a lower profile arranged on said unlock slider, and one or more side reliefs, arranged on said activation member, in order to interact with said cams, such that, with said prong retained by said mechanical module, pressing said activation element, said side reliefs of said activation member interact with said upper profile of said cams, causing the interaction of said unlock slider with said mechanical module to release said prong, while, when said prong is close to said mechanical module to be retained for closing the door, keeping pressed said activation element, each of said side reliefs follows the profile of the respective cam, to which it remains constrained by the combined action of said contrast means and said returning means of said unlock slider, sliding on said lower profile of the respective cam, so that the action of said returning means on said unlock slider allows said mechanical module to retain said prong.

Still according to the invention, said mechanical module could comprise a hook suitable to engage and retain said prong when said door is closed, and a strut, interacting with said hook, in order to keep said strut engaged with said prong, when said door is closed, and in that said unlock slider comprises a projection, suitable to interact with said strut to disengage it, in its turn, from said hook, so that said hook disengages from said prong, allowing the opening of the door.

Advantageously according to the invention, said unlock slider could be arranged under said strut.

Further according to the invention, said activation member could have a slot, and said contrast means could comprise a first spring, inserted within said slot and connected with said activation element, so that said first spring is compressible by said activation element, and so that after pressing, said activation element returns to its original position.

Always according to the invention, said returning means comprise a second returning spring.

Still according to the invention, said button is operated by the handle of said door or by a further member.

Further according to the invention, said device could comprise an electric module provided with an activation and block pin, capable to assume an operating position, in which it is extracted to inhibit the operating of the device, preventing the opening of said door, and a resting position, in which it is retracted, said mechanical module could comprise a block slider, capable of interacting with said activation and block pin, such that when it is in said operating position, said block slider remains blocked, and said strut can be operatively connected with said block slider.

Advantageously according to the invention, said device could comprise a emergency lever, manually operable and capable to activate a mechanism, in order to force the passage of said activation and block pin from said operating position to said rest position.

The present invention will be now described, for illustrative but not limitative purposes, according to its preferred embodiments, with particular reference to the figures of the enclosed drawings, wherein.

FIG. 6*a* shows a plan view of a mechanical module of said door lock device in a closed position;

FIG. 6*b* shows a first perspective view of the mechanical module according to FIG. 6*a;*

FIG. 6*c* shows a second perspective view of the mechanical module according to FIG. 6*a;*

FIG. 7*a* shows a plan view of a mechanical module of said door lock device in opening phase;

FIG. 7*b* shows a first perspective view of the mechanical module according to FIG. 7*a;*

FIG. 7*c* shows a second perspective view of the mechanical module according to FIG. 7*a;*

Figure 10:
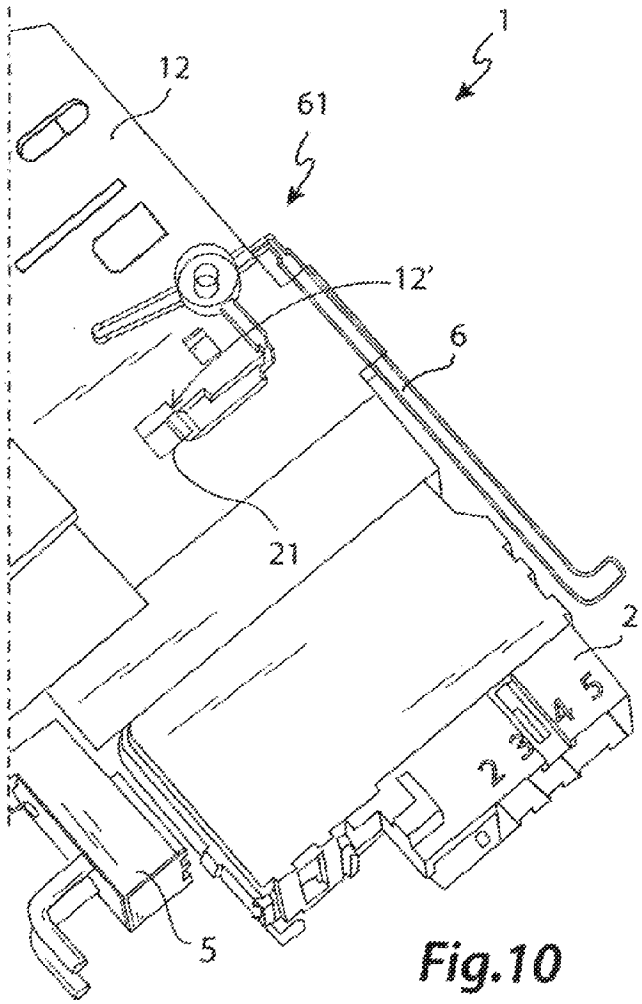
Figure 9:
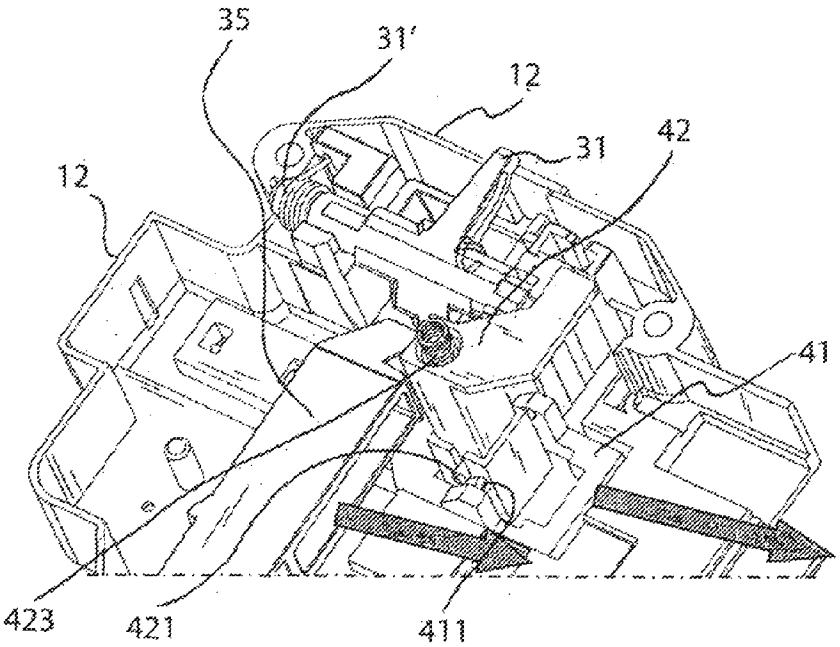

FIGS. 8*a*, 8*b*, 8*c* and 8*d* show an operating sequence of said door lock device in closing phase;

FIG. 9 shows a perspective view of the door lock device according to the invention after that a prong of a door has been extracted; and FIG. 10 shows an emergency mechanism of the door lock device according to the invention.

In the various figures, similar parts will be indicated by the same reference numbers.

Figure 1:
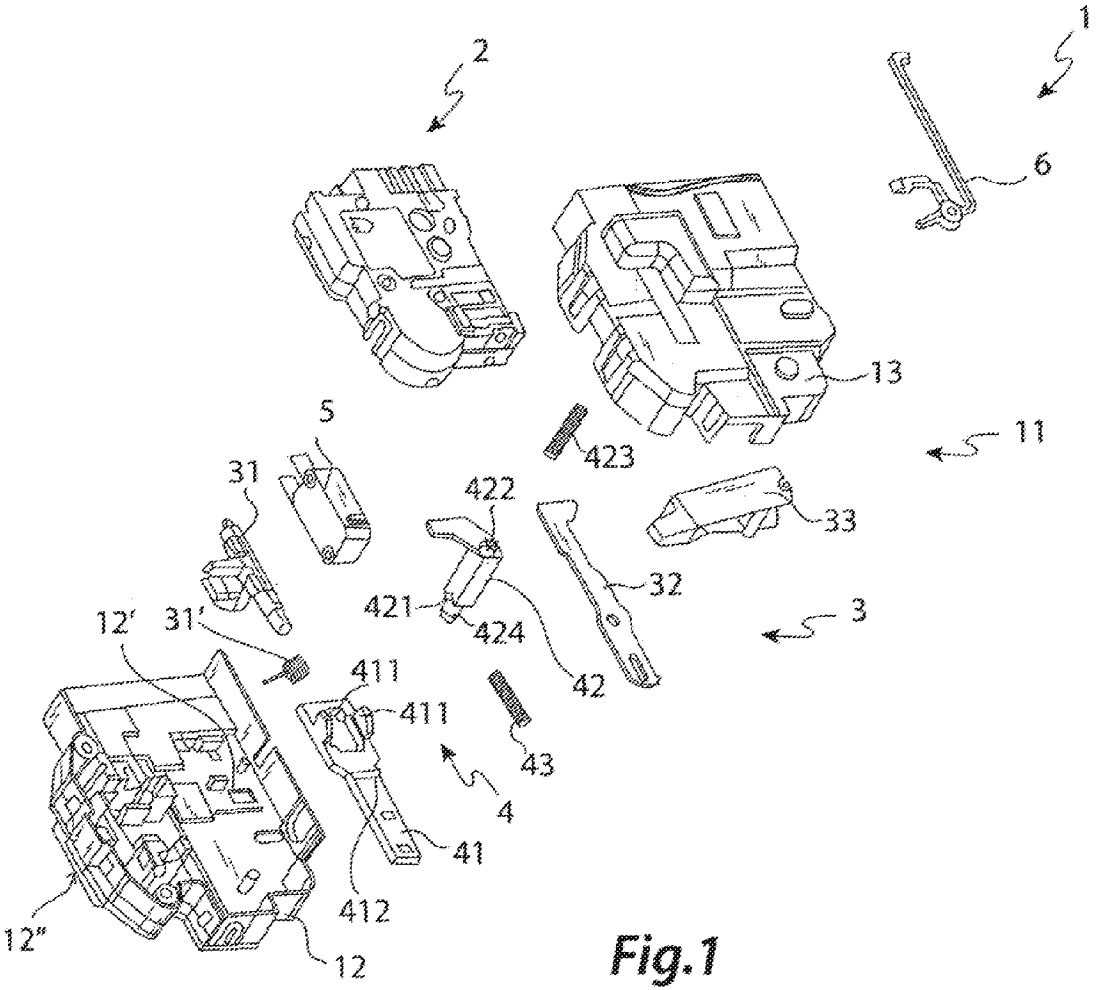
FIG. 1 is an exploded view of the door lock device according to the present invention.
Figure 2:
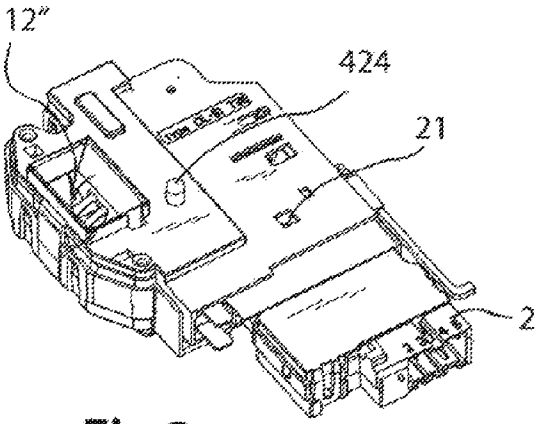
FIG. 2 shows a perspective view of the door lock device according to FIG. 1 completely assembled.
Figure 5:
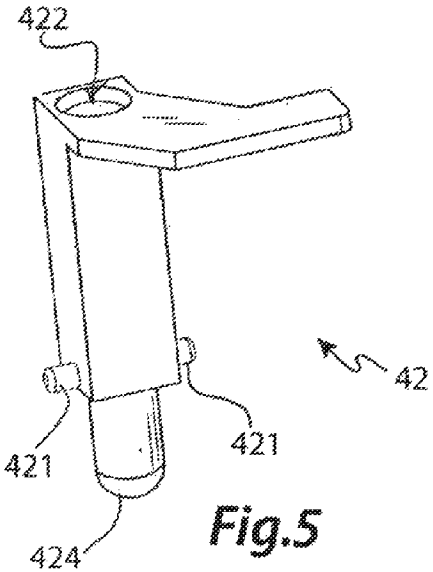
FIG. 5 shows an activation member of the door lock device according to FIG. 1.
Figure 3:
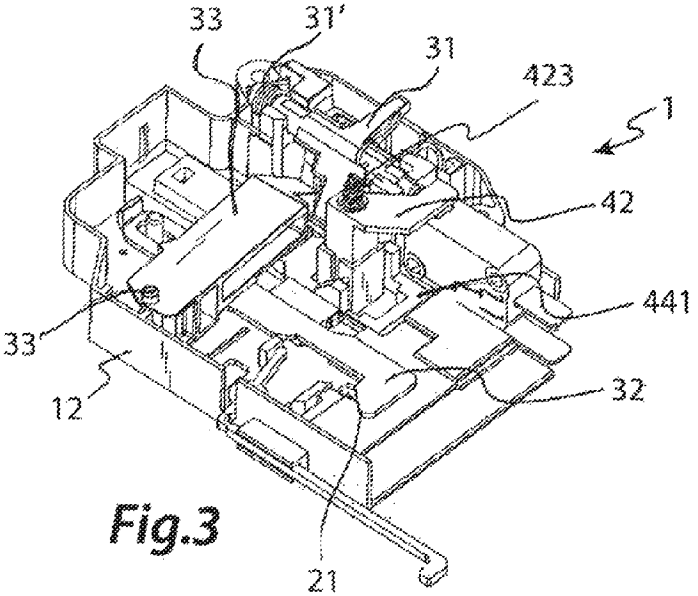
FIG. 3 shows a perspective view of the door lock device according to FIG. 1 with the upper cover removed.

Referring to FIGS. 1-3, a door lock device 1 according to the present invention, for a household appliance, such as a washing machine or the like, can be seen.

Said door lock device 1 comprises a casing 11, in which an electrical module 2 and a mechanical module 3 and opening means 4 of the door are housed.

Said casing 11 comprises a lower base 12, having a first opening 12', whose operation will be, better explained below, and a second opening 12", through which the door prong of a washing machine can enter or exit. Said casing 11 also comprises an upper cover 13, coupled by interlocking with said lower base 12.

Said electric module 2 is connected to, and controlled by, a logical unit of the household appliance and comprises an activation and block pin 21, capable of assuming an operating position, in which it is extracted, so as to inhibit the operation of the mechanical module 3, as it will be better described below, and a resting position, in which it is retracted. Said activation and block pin 21 is arranged in correspondence of said first opening 12'.

Said mechanical module 3 is adapted to interact with said door prong of said washing machine, to hold or release it.

In particular, said mechanical module 3 comprises a rotary hook 31, pivoted to said casing 11 and provided with a suitable returning spring 31'. Said rotary hook 31 is capable to engage with the prong, when the door is in closed position.

Said mechanical module 3 further comprises a strut 33 horizontally movable, pivoted at the point 33', interacting with said rotary hook 31 and provided, also, with a returning spring (not visible in the figures). When the prong interacts with the hook 31, the latter rotates, contrasting the action of said returning spring with said strut 33. Said strut 33, can also position in a suitable profile of the hook 31, keeping the latter engaged with the prong. Said returning spring of the strut 33 is arranged eccentrically with respect to the center of rotation of the strut 33, thus generating a motion both axial as well as rotary.

Said mechanical module 3 also comprises a block slider 32, mechanically connected with said strut 33. Said block slider 32 can assume a first position and a second position. In said first position the door is closed, the prong is engaged with said rotary hook 31 and said slider 32 is arranged so as to leave the activation and block pin 21 free to move. In this way, the activation and block pin 21 can prevent the movement of said slider 32, and, then, the door opening, when extracted (door closed and washing machine activated).

In said second position, the door is open, the prong disengaged from said rotary hook 31 (door open) and said slider 32 is arranged so as to be above said activation and block pin 21. In this way, said activation and block pin 21 is necessarily in retracted position.

When the activation and block pin 21 is retracted, for example when the washing machine is switched off or has finished a program, it releases the cursor 32. In this way, said slider 32 can move from said first to said second position, to allow the disengagement of said strut 33 by said rotary hook 31 and open the door, according to the dynamics that will be described below.

Figure 4:
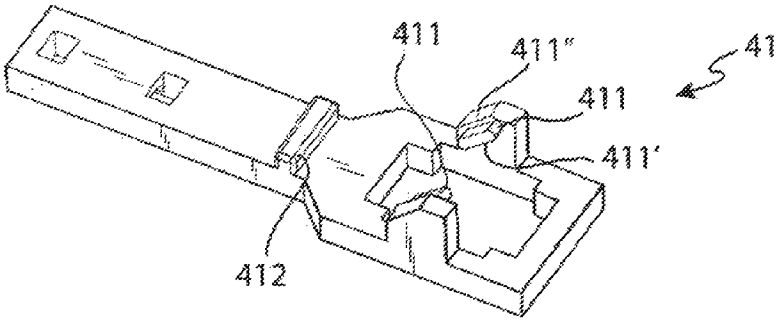
FIG. 4 shows an unlock slider of the door lock device according to FIG. 1.
Figure 8A:
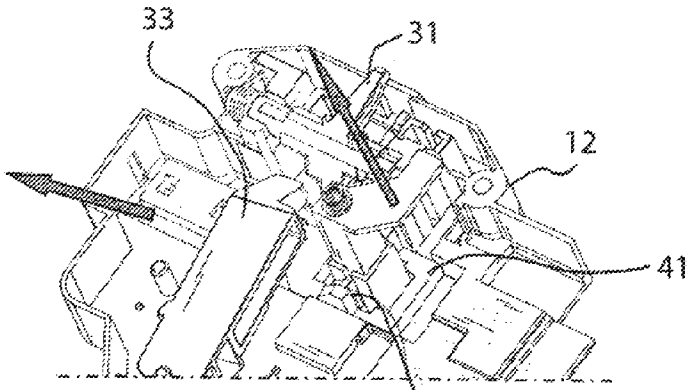
Figure 8B:
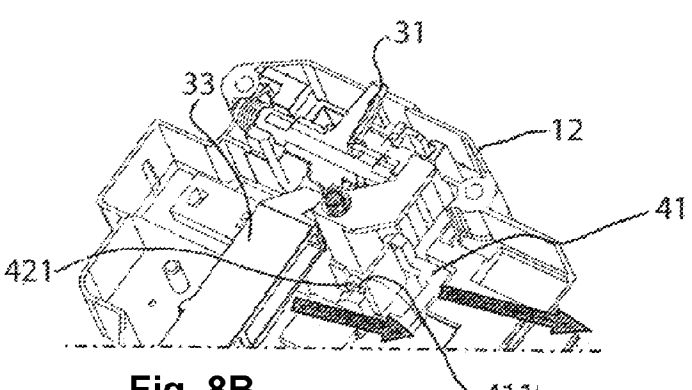
Figure 8C:
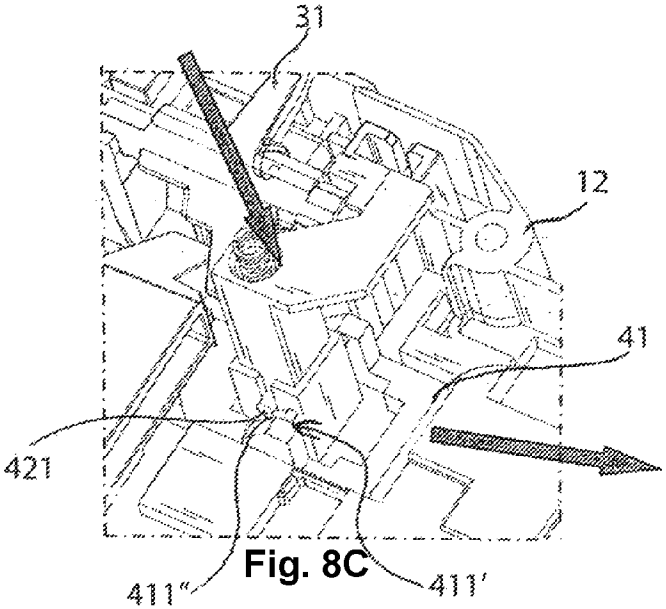
Figure 8D:
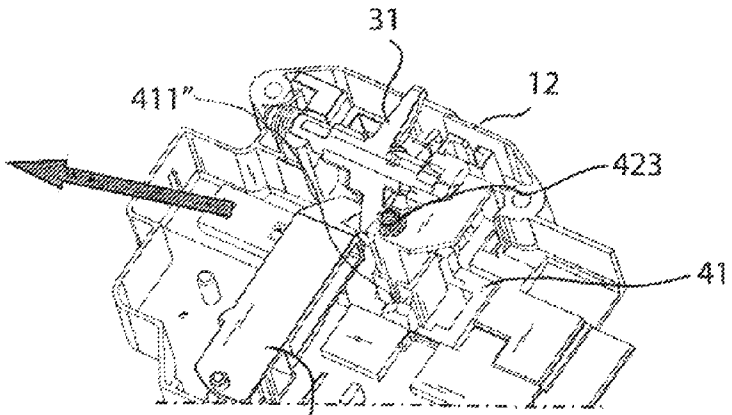

Door opening means 4 comprise a unlock slider 41 (see also FIG. 4), arranged below said strut 33 and provided with cams 411, each cam having an upper profile 411' and a lower profile 411", and a projection 412, suitable for interacting with said strut 33, as will be better explained below.

Said opening means 4 also comprise an activation member 42, having lateral reliefs 421, arranged so as to interact with said cams 411, as it will be better defined in the following, and a slot 422 for a first spring 423. Said first spring 423 is compressible by pressing the button 424 that can also be activated externally with respect to said casing 11 by means of said handle, or even by means of a further member placed on the handle of the door itself. Said activation member 42 is constrained to move vertically.

Said opening means 4 also comprise a second returning spring 43 of said unlocking slider 41.

Moreover, said device 1 also comprises a sensor 5, adapted to detect if the door is open or closed.

Finally, the door lock device 1 is completed by an emergency lever 6, connected to a mechanism 61 that can be activated manually and adapted to force the passage of said activation and block pin 21 from said operating position to said resting position.

The operation of the door lock device 1 described above is as follows.

When the door of the washing machine is closed, the prong of the door is kept engaged with said rotary hook 31 by means of said strut 33 (see FIGS. 6*a*-6*c*). During washing phases, the activation and block pin 21 is in said operating position, i.e. extracted, so as to inhibit movement of said block slider 32 and therefore of said strut 33. In this way, also said unlock slider 41 is blocked, by interacting with said strut 33, in a resting position or closing position. Then, by pressing the button 424, the door is not opened.

When the washing machine ends the washing program, the activation and block pin 21 returns to said resting position, in which it is retracted, allowing said block slider 32 to move. By pressing now said button 424, or by pressing on the handle of the door, said activation member 42 is vertically moved and the consequent interaction of said lateral reliefs 421 on the upper profile 411' of said cams 411, causes the movement of said unlock slider 41, bringing it in an operating position or opening position. In this way, said projection 412 of said unlock slider 41 interacts with said strut 33, pushing it in the direction of the arrow A (see FIG. 7*a*), disengaging it from said rotary hook 31, and allowing said strut to rotate with respect to the point 33', so that said rotary hook 31 disengages from the prong. Once the rotary hook 31 is released, the combined effect of the reactions of the spring 31', the first spring 423 of button 424, together with the contribution of the door seal (not visible in the figures), cause the opening of said door (see also arrows of FIGS. 7*a*-7*c*).

Then, the button 424 returns to its initial position, due to the effect of said first spring 423. Said unlock slider 41 and said strut 33, the latter disengaged from said rotary hook 31, return to their original position.

Instead, when the washing machine is switched off and the door is open, the closing of the door takes place by pressing on the handle as described as follows. With reference to FIGS. 8*a*-8*d*, by inserting the prong in said second opening 12" of the door lock 1, said prong engages with the rotary hook 31, but the action on the handle, and then on the button 424, implies that, in a first step (FIG. 8*a*) each of said lateral reliefs 421 slides on the upper profile 411' of the respective cam 411. In this case, said unlock slider 41 is in said operating position or opening position (see again FIG. 7*a*). This prevents said strut 33 to engage with said rotary hook 31. When the door approaches the window to be closed, continuing to exert a pressure on said handle (see the sequence of FIGS. 8*b*, 8*c* and 8*d* and the arrows shown), and then on said button 242, each of said lateral reliefs 421 follows the profile of the respective cam 411, to which it remains constrained due to the combined action of said first spring 423 and said second returning spring 43 of said unlock slider 41, sliding on the lower profile 411" of the respective cam 411. In this way, the action of said second spring 43 on the unlock slider 41 returns said slider in said resting position or closing position, so that said strut 33 engages with said rotary hook 31, by means of the projection 412.

Then, when user releases the handle, reducing the pressure on said button 424, said activation member 42 returns to its initial position, by the action of said first spring 423, sliding initially on said lower profile 411", in order to arrange, then, in correspondence of said upper profile 411' of the cam 411 (see FIG. 9). As mentioned above, device 1 comprises an emergency lever 6, whereby it is possible to operate the mechanism 61, which pushes down the activation and block pin 21, in case it were in the operating position, i.e. extracted, coming out from said first opening 12', forcing it in said resting position, i.e. retracted (see FIG. 9).

The present invention, has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A door lock device for a household appliance door, said household appliance door being provided with a prong, said device comprising:

a mechanical module, for retaining said prong in a closed position, or releasing said prong for an opening of said household appliance door, opening means, comprising:

an unlock slider, movable between a first position and a second position, and capable to interact with said mechanical module, returning means of said unlock slider in said first position, and an activation member, having an activation element and guiding means for a mutual movement between said unlock slider and said activation member, wherein, when said prong is retained by the mechanical module, upon pressing said activation element, said guiding means cause an interaction of said unlock slider with said mechanical module to release said prong, and wherein when said prong is brought close to said mechanical module to be retained for closing the household appliance door, by keeping pressed said activation element, said guiding means allow said mechanical module to retain said prong by a combined action of contrast means and said returning means of said unlock slider, and wherein said guiding means comprises:

one or more cams, each of which has an upper profile and a lower profile arranged on said unlock slider, and one or more side reliefs, arranged on said activation member, in order to interact with said one or more cams, wherein, with said prong retained by said mechanical module, upon pressing said activation element, said one or more side reliefs of said activation member interact with said upper profile of said one or more cams, causing the interaction of said unlock slider with said mechanical module to release said prong, and wherein, when said prong is brought close to said mechanical module to be retained for closing the door, by keeping pressed said activation element, each of said one or more side reliefs follows a profile of a respective cam, to which it remains constrained by a combined action of said contrast means and said returning means of said unlock slider, sliding on said lower profile of the respective cam, so that an action of said returning means on said unlock slider allows said mechanical module to retain said prong.

2. The device according to claim 1, wherein said mechanical module further comprises:

a hook suitable to engage and retain said prong when said household appliance door is closed, and a strut, interacting with said hook, in order to keep said hook engaged with said prong, when said household appliance door is closed, wherein said unlock slider further comprises a projection, suitable to interact with said strut to disengage said strut from said hook, so that said hook disengages from said prong, allowing opening of the household appliance door.

3. The device according to claim 2, wherein said unlock slider is arranged under said strut.

4. The device according to claim 1, wherein said activation member has a slot, and said contrast means comprises a first spring, inserted within said slot and connected with said activation element, so that said first spring is compressible by said activation element, and after pressing, said activation element returns to its original position.

5. The device according to claim 1, wherein said returning means comprises a returning spring.

6. The device according to claim 1, wherein said activation element is operated by a handle of said household appliance door or by a further member.

7. The device according to claim 2, further comprising an electric module provided with an activation and block pin, capable of assuming an operating position, in which the activation and block pin is extracted to inhibit operation of the device, preventing the opening of said household appliance door, and a resting position, in which the activation and block pin is retracted, wherein said mechanical module further comprises a block slider, capable of interacting with said activation and block pin, such that when said activation and block pin is in said operating position, said block slider remains blocked, and wherein said strut is operatively connected with said block slider.

8. The device according to claim 7, further comprising an emergency lever, manually operable and capable to activate a mechanism, in order to force passage of said activation and block pin from said operating position to said rest position.

9. The device according to claim 1, wherein the activation element is a button.

* * * * *